US010638822B2

(12) United States Patent
Fagu et al.

(10) Patent No.: US 10,638,822 B2
(45) Date of Patent: May 5, 2020

(54) STORAGE AND DISPLAY DEVICE FOR STORING AND DISPLAYING A PLURALITY OF LONGITUDINAL HAND HELD IMPLEMENTS

(71) Applicant: SOCIETE BIC, Clichy (FR)

(72) Inventors: Ludovic Fagu, Noisy le Sec (FR); Franck Vadenne, Bezons (FR); Etienne Michenaud, Paris (FR); Didier Lange, Saint Leonard (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/096,427

(22) PCT Filed: Apr. 19, 2017

(86) PCT No.: PCT/FR2017/050933

§ 371 (c)(1),
(2) Date: Oct. 25, 2018

(87) PCT Pub. No.: WO2017/187051

PCT Pub. Date: Nov. 2, 2017

(65) Prior Publication Data

US 2019/0133276 A1 May 9, 2019

(30) Foreign Application Priority Data

Apr. 25, 2016 (FR) ..... 16 53624

(51) Int. Cl.

| | |
|---|---|
| ***A45C 11/34*** | (2006.01) |
| ***B25H 3/02*** | (2006.01) |
| ***B43M 99/00*** | (2010.01) |

(52) U.S. Cl.

CPC ..... *A45C 11/34* (2013.01); *B25H 3/025* (2013.01); *B43M 99/006* (2013.01); *A45C 2200/15* (2013.01)

(58) Field of Classification Search

CPC ..... A45C 11/34; A45C 11/36; A45C 2200/15; B25H 3/02; B25H 3/025; B43K 31/00; (Continued)

(56) References Cited

U.S. PATENT DOCUMENTS 2,009,360 A * 7/1935 Ludwig ..... B43M 99/003 211/69.5
4,669,617 A 6/1987 Boeckmann et al.
(Continued)

FOREIGN PATENT DOCUMENTS

| | | | |
|---|---|---|---|
| DE | 3434812 | 2/1986 | |
| DE | 3516824 C1 * | 9/1986 | ..... A45C 11/34 |
| FR | 2796817 | 2/2001 | |

OTHER PUBLICATIONS

International Search Report dated Aug. 16, 2017 in corresponding International PCT Patent Application PCT/FR2017/050933.

*Primary Examiner* — Bryon P Gehman
(74) *Attorney, Agent, or Firm* — Ohlandt, Greeley, Ruggiero & Perle, L.L.P.

(57) ABSTRACT

A storage and presentation device for storing and presenting a plurality of longitudinal hand held implements, the storage and presentation device presenting a plurality of supports, each support being configured to support one longitudinal hand held implement, all of the supports being mounted to be rotatable about a common axis extending substantially perpendicularly to the longitudinal directions of the longitudinal hand held implements when they are supported by the supports. The storage and presentation device presenting a storage position in which the angle between all of the supports about the axial direction is less than 2°, and a presentation position in which, for all of the supports, the angle between two adjacent supports about the axial direction is greater than or equal to 5°.

9 Claims, 7 Drawing Sheets

(58) Field of Classification Search
CPC .... B43M 17/00; B43M 99/00; B43M 99/003; B43M 99/006; B43M 99/007
USPC ..... 206/214, 739, 759; 211/69.5–69.9
See application file for complete search history.

(56) References Cited

U.S. PATENT DOCUMENTS

| | | | | |
|---|---|---|---|---|
| 5,020,662 | A * | 6/1991 | Aida | A45C 11/36 206/214 |
| 6,398,027 | B1 | 6/2002 | Ryu | |
| 2008/0011634 | A1 | 1/2008 | Lin | |

* cited by examiner

STORAGE AND DISPLAY DEVICE FOR STORING AND DISPLAYING A PLURALITY OF LONGITUDINAL HAND HELD IMPLEMENTS

FIELD OF THE INVENTION

The invention relates to a storage and presentation device for both storing and also presenting a plurality of longitudinal hand held implements, for example, but not necessarily, writing instruments.

BACKGROUND

Storage devices for longitudinal hand held implements generally do not enable the implements to be presented ergonomically in order to be able to use them, while presentation devices for said implements are generally not adapted to optimal storage of said implements. There therefore exists a need on these lines.

SUMMARY OF THE INVENTION

An embodiment of the invention provides a storage and presentation device for storing and presenting a plurality of longitudinal hand held implements, the storage and presentation device presenting a plurality of supports, each support being configured to support one longitudinal hand held implement, all of the supports being mounted to be rotatable about a common axis extending substantially perpendicularly to the longitudinal directions of the implements when they are supported by the supports, said storage and presentation device presenting a storage position in which the angle between all of the supports about the axial direction is less than 2° (two degrees of angle), and a presentation position in which, for all of the supports, the angle between two adjacent supports about the axial direction is greater than or equal to 5° (five degrees of angle).

Below, unless specified to the contrary, the term "device" means a "storage and presentation device" and the term "implement" means an "longitudinal hand held implement".

The device can thus occupy two positions, a storage position in which the implements are stored, and a presentation position, in which the implements are presented or exposed in such a manner as to make it easier to select and take hold of any one of them.

It can be understood that the longitudinal direction is specific to each implement while the axial direction is the direction defined by the rotation axis about which the supports rotate and which is common to all of the supports. When the implements are arranged in the supports, all of the implements extend perpendicularly to the axial direction, or in other words, the longitudinal direction of each of the implements is perpendicular to the axial direction.

The supports can pivot about the axial direction. In the storage position, the angle about the axial direction between any two supports from among the set of supports is no more than 2°. Thus, when considered in the storage position, the implements are arranged substantially in a common plane. By means of this configuration, the space occupied by the set of implements is very small, which is advantageous for storing them.

In the presentation position, the angle about the axial direction between two adjacent supports is greater than or equal to 5°, with this applying to all of the supports in the plurality of supports. This serves to provide sufficient space around each implement carried by a support for a user to identify each implement easily and to be able to take hold of it directly, just as easily, and without any need to manipulated the other implements. Thus, in the presentation position, the supports are organized substantially in a generally helical shape along the axial direction.

It should be observed that in order to measure the angle between two supports, a geometrical reference line is taken for each support, which reference line is constituted by the geometrical line passing through the geometrical center of the holding zone of the implement and the point at which said support rotates about the axial direction.

Thus, the storage and presentation device serves both to optimize storage and also to provide ergonomic presentation of the implements.

In some embodiments, when considered along the axial direction, the plurality of supports presents a first support and a last support, the first support and the last support each presenting at least one lug, said lug extending in the axial direction towards the adjacent support, while all of the other supports presents a pair of lugs, each lug of each pair of lugs extending in the axial direction away from the other lug of the pair of lugs, each lug of a support being configured to co-operate in abutment with a corresponding lug of the adjacent support, each lug being offset in azimuth relative to the corresponding lug of the adjacent support when in the storage position, the azimuth direction being defined by the rotation direction of the supports so that moving a storage through a predetermined angular stroke in a first rotation direction couples said support with an adjacent support in the first rotation direction by co-operation in abutment between corresponding lugs.

It can be understood that the supports are arranged successively in series along the axis. Thus, in the axial direction, it can be considered that there is a first support, a second support, . . . , a penultimate support, and a last support. Each of the first and last supports presents a lug pointing axially towards the adjacent support, i.e. respectively towards the second support or towards the penultimate support. Each of the intermediate supports between the first support and the last support presents a pair of lugs. Each lug of each support co-operates in abutment with a corresponding lug of an adjacent support. Thus, the lug of the first support co-operates in abutment with one of the lugs of the second support, while the other lug of the second support co-operates in abutment with one of the lugs of the third support, etc. Likewise, the penultimate support presents a lug that co-operates in abutment with a lug of the anti-penultimate support, and another lug that co-operates in abutment with the lug of the last support.

The corresponding lugs in each pair of adjacent supports are offset in the azimuth direction so that when the first support is caused to rotate through a predetermined angular stroke, the lug of the first support comes into abutment against a lug of the second support so as to couple the second support to rotate with the first support. When the first and second supports have once more moved through a second predetermined angular stroke, the second lug of the second support comes into abutment against a lug of the third support, thereby coupling the third support to rotate with the first and second supports, etc.

Thus, by means of this configuration of lugs, by pivoting only one support, namely the first support, it is possible to deploy all of the supports in a helix. Naturally, the angular offset between the two corresponding supports may vary from one pair of adjacent supports to another, or it may be identical for all of the pairs of adjacent supports.

In some embodiments, the corresponding lugs in each pair of adjacent supports are angularly spaced apart by at least 5°.

This serves to ensure that the angle between each pair of adjacent supports is indeed not less than 5° in the presentation position.

In some embodiments, the angular spacing between the corresponding lugs of each pair of adjacent supports is identical for all of the pairs of adjacent supports.

This makes it possible to obtain a balanced presentation of the implements and a uniform distribution of the weights of the implements within the device, thereby improving the stability of the device.

In some embodiments, all of the supports are identical, each support having a pair of lugs, each lug of each pair of lugs extending in the axial direction away from the other lug of the pair of lugs, while being offset relative to each other in the azimuth direction.

By having all of the supports identical, the device is made easier to assemble and the uniformity with which the implements are presented in the presentation position is improved.

In some embodiments, all of the supports are pivotally mounted on a common rod.

It can be understood that the axis of the rod forms the axis about which the supports pivot. One single rod in common with all of the supports makes the device easy to assemble during manufacture. Furthermore, since the implements are arranged in the form of a helix around this rod, the rod takes up the weight of all of the implements supported by the supports so that certain components of that weight balance out one another, thereby improving the equilibrium and the stability of each of the supports and thus of the device as a whole.

In some embodiments, the storage and presentation device comprises two covers forming a box, the covers being rotatably mounted relative to each other about the axial direction, the box being closed in the storage position, while the box is open in the presentation position, at least one of the covers forming a base in the presentation position.

It can be understood that the storage and presentation device comprises a box in which the supports are arranged, the box comprising two covers. These two covers are hinged to each other to rotate about the rotation axis of the supports. By means of this hinged arrangement, the box can occupy a closed position and an open position. When the box is closed, the device is in the storage position, while when the box is open the device is in the presentation position. Furthermore, when the box is open, the two covers are arranged in such a manner that at least one of them, and possibly both of them, form(s) a base for the device, thereby providing a degree of stability when the device is placed on any support, such as for example a table, a desk, or the equivalent.

In some embodiments, the covers present hinge knuckles, the common rod being engaged in the hinge knuckles, the common rod co-operating by snap-fastening with two hinge knuckles whereby the common rod is prevented from moving in translation along the axial direction.

Within a hinge, a hinge knuckle is a hollow portion forming a female component configured to receive a pin that is formed in this example by the rod, the pin forming a male component. By way of example, an eyelet or a hollow cylindrical portion could constitute a hinge knuckle.

Since the common rod is also subjected to mechanical stresses by the covers, the equilibrium of the set in the presentation position is improved.

Snap-fastening (or clip-fastening) is a technique for assembling together two portions by engaging them mutually and by elastic deformation (in general local deformation of a portion only of one part, e.g. a tongue or a peripheral element of that part, or else possibly by deforming all of the parts involved in the assembly). When two portions are engaged in the snap-fastened position, they have generally returned to their initial shape so that they no longer present any elastic deformation (or at least less elastic deformation). When the two portions are engaged with each other in the snap-fastened position, they co-operate with each other so as to oppose, or indeed prevent, any relative movement between said portions in the disengagement direction (the direction opposite to the engagement direction). In the snap-fastening position, the two portions can also co-operate so as to oppose, or indeed prevent, relative movements in a direction in which the engagement direction extends, i.e. beyond the snap-fastening position. Assembly by snap-fastening presents the advantage of being easy to perform and reliable.

For example, each of the two hinge knuckles arranged at the ends of the rod in the axial direction presents a projecting internal portion in relief, the hinge knuckles possibly belonging to the same cover, or else each of them belonging to a distinct cover. The portion(s) in relief of one of the hinge knuckles prevent(s) movement of the rod in translation in a first direction along the axis, while the portion(s) in relief of the other hinge knuckle prevent(s) movement of the rod in translation in a second direction opposite to the first direction along the axis. Thus, in order to assemble the device, the hinge knuckles of the covers and the corresponding portions of the supports are put into alignment, the rod is inserted through a hinge knuckle that presents a portion in relief and the rod is engaged until it comes into axial abutment against the portion in relief of the other hinge knuckle having a portion in relief. Naturally, the length of the rod is shorter than the axial distance between the portions in relief of the two hinge knuckles.

In some embodiments, when considered in the axial direction, the plurality of supports presents a first support and a last support, a lug of the first support co-operating in abutment with one of the covers, while a lug of the last support co-operates in abutment with the other cover, whereby opening the box carries the supports in rotation about the axial direction.

It can thus be understood that when one cover is caused to pivot relative to the other, the cover carries a support in rotation, thus making it possible automatically to bring the device into the presentation position while opening the box. It can be understood that when closing the box, the supports and/or the implements come successively into abutment against the cover that is being folded down, such that closing the box brings the device automatically into its storage position.

In some embodiments, the covers are fitted with complementary locking means for locking the covers together in the storage position.

This makes it possible to ensure that the box remains closed, including while the device is being transported, thereby making the storage position safe.

In some embodiments, each support forms a sleeve configured to receive and hold one end of an longitudinal hand held implement.

Under such circumstances, it can be understood that each sleeve extends in a longitudinal direction corresponding to the longitudinal direction of the implement carried by said support. Such a support structure is particularly well adapted for effectively holding the implement in the storage position and in the presentation position.

For example, the axis of each sleeve passes through the point at which the support rotates about the axial direction and forms the geometrical reference line used for measuring the angle between supports.

In some embodiments, the longitudinal hand held implements are writing instruments.

For example, the writing instrument may be a pen, a felt-tip pen, a pencil, a stylus for a touch screen, or any other device for writing or drawing.

The device is particularly well adapted to storing and presenting writing instruments, e.g. a set of color crayons or felt-tip pens, e.g. for children.

By way of example, when the writing instrument has a cap, the support is configured to co-operate with the cap of the writing instrument so that the force needed to extract the cap from the support is greater than the force needed to extract the body of the writing instrument from the cap. Thus, by taking hold of the body of the writing instrument, the cap remains assembled with the support, thereby preventing the user from losing the cap. Such a configuration is particularly advantageous when the device fitted with color writing instruments is used by children.

An embodiment also provides a set comprising a storage and presentation device according to any of the embodiments described in the present disclosure together with at least one writing instrument.

In some embodiments, the writing instrument has a cap, at least one support being configured to co-operate with the cap of the writing instrument in such a manner that the force needed for extracting the cap from the support is greater than the force needed for extracting the body of the writing instrument from the cap.

BRIEF DESCRIPTION OF THE DRAWINGS

The invention and its advantages can be better understood on reading the following detailed description of various embodiments of the invention given as non-limiting examples. The description refers to the accompanying sheets of figures, in which.

DETAILED DESCRIPTION OF EMBODIMENTS

Figure 1:
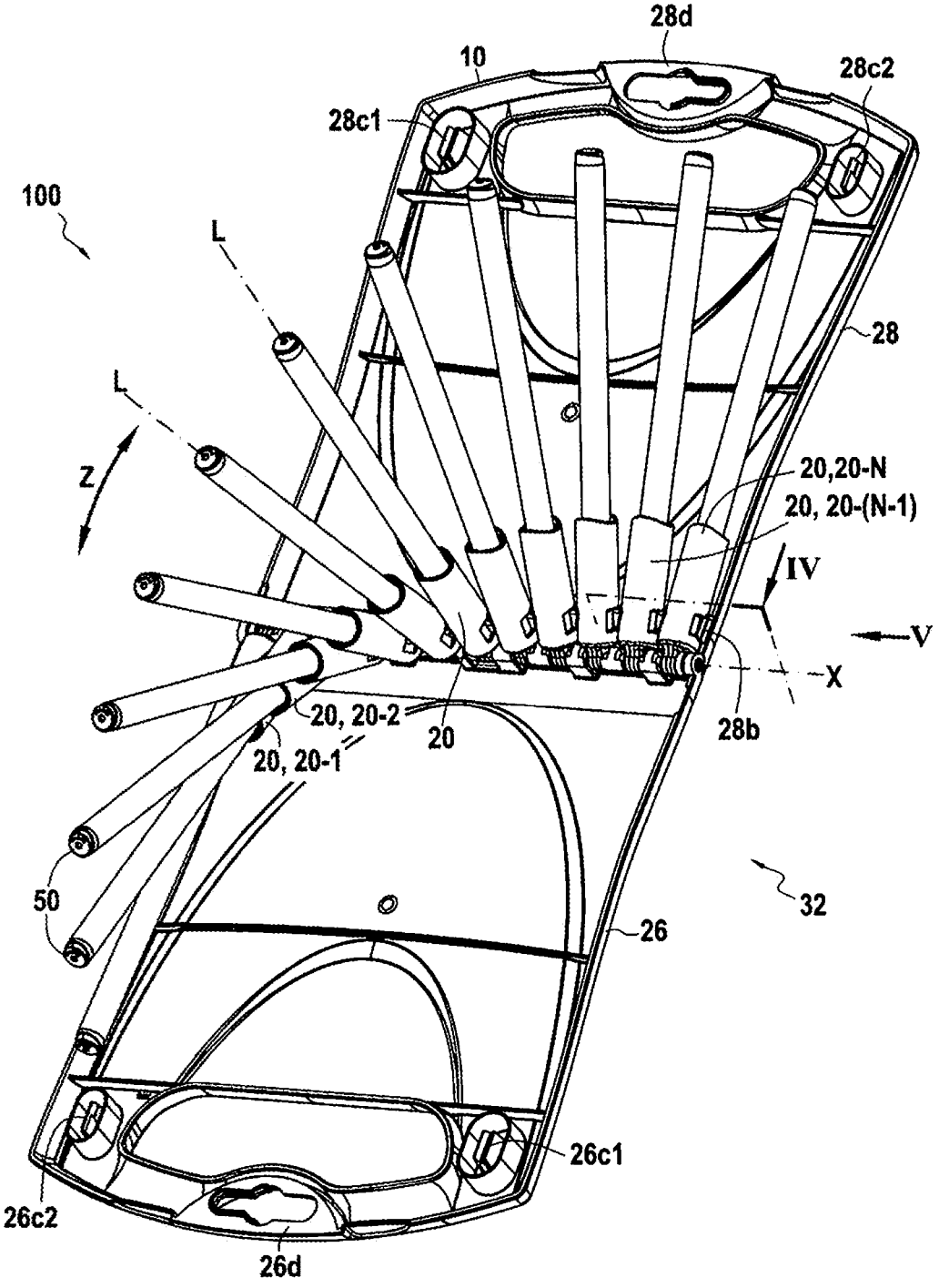
FIG. 1 shows a set comprising a storage and presentation device together with as many felt-tip pens as it has supports, the set being shown in a presentation position.

FIG. 1 shows an embodiment of a set 100 comprising a storage and presentation device 10 for storing and presenting a plurality of longitudinal hand held implements, in this example felt-tip pens 50. The device 10 has covers 26 and 28 forming a box 32. In FIG. 1, the device 10 is in the presentation position, with all of the supports 20 supporting a respective felt-tip pen 50. It should be observed that in this example, the covers 26 and 28 form a box 32 that is in the form of an attaché case, but naturally any other form of box could be envisaged. It should also be observed that in the presentation position, the two covers 26 and 28 of the open briefcase form a base for the device 10.

More particularly, in this example, the device 10 has a plurality of supports 20 that are rotatably mounted about a common axis X (i.e. a common rotation axis for all of the supports 20) that extends perpendicularly to the longitudinal directions L of the felt-tip pens 50, with all of the supports 20 being identical. It should be observed that in this example, the covers 26 and 28 are also identical. The supports 20 are movable in rotation about the axis X in the azimuth direction Z. In this example, the axial direction X, the longitudinal direction L, and the azimuth direction Z correspond respectively to the directions defined by the height, the radius, and the angle in a cylindrical coordinate system.

Figure 3A:
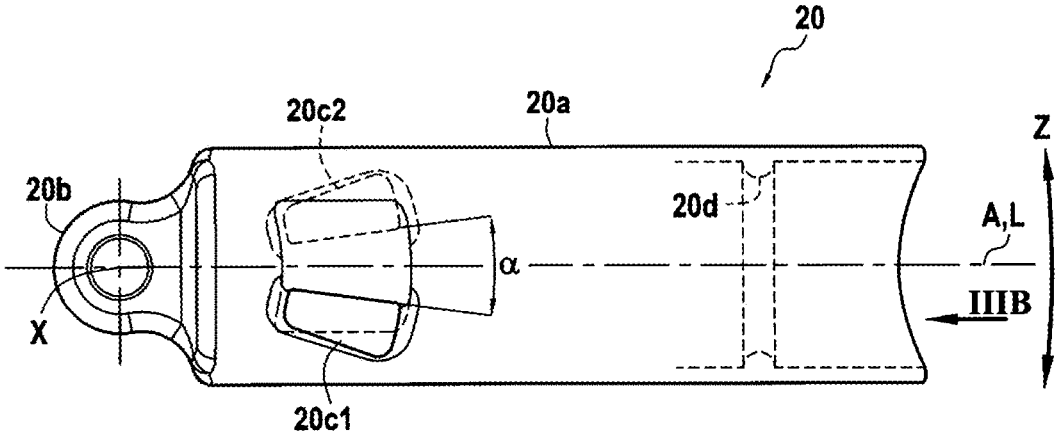
FIGS. 3A and 3B show a support.
Figure 3B:
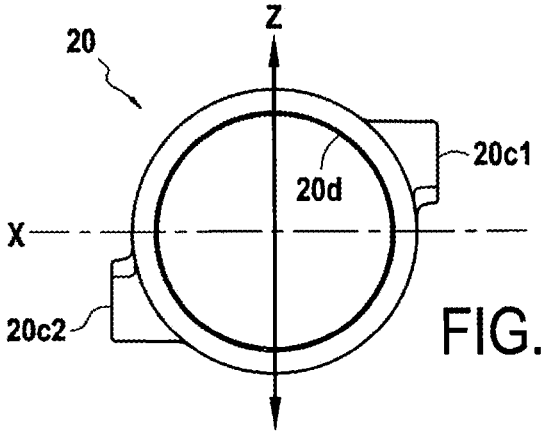
Figure 5A:
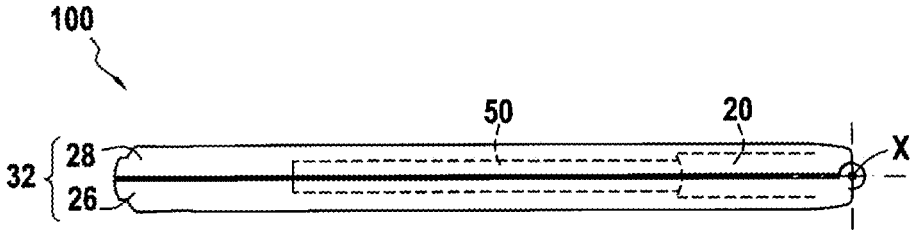
FIGS. 5A to 5E show various steps in the kinetics of opening the box and causing the storage and presentation device as seen looking along arrow V in FIG. 1 to pass from the storage position to the presentation position.
Figure 5B:
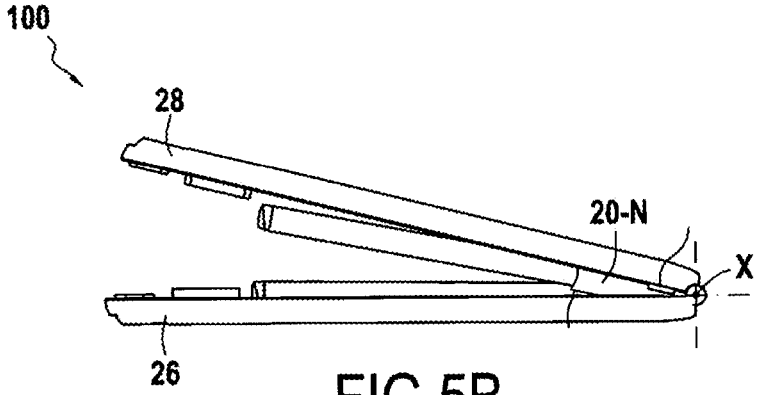
Figure 5C:
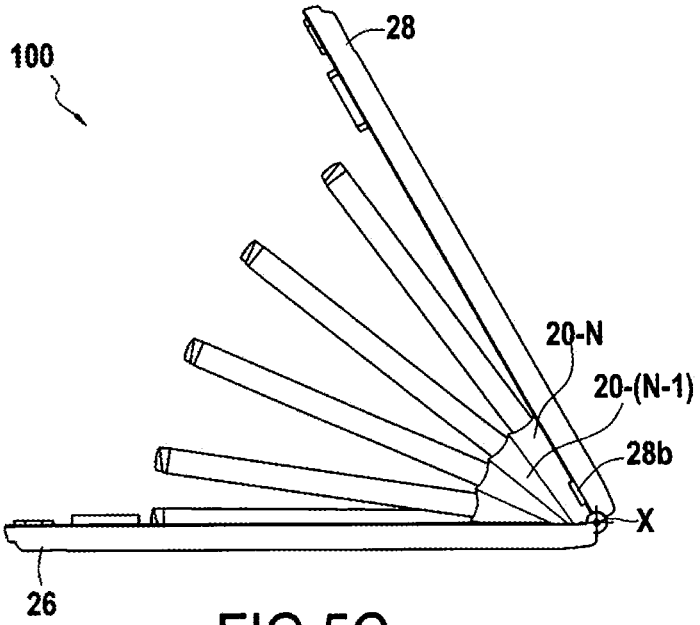
Figure 5D:
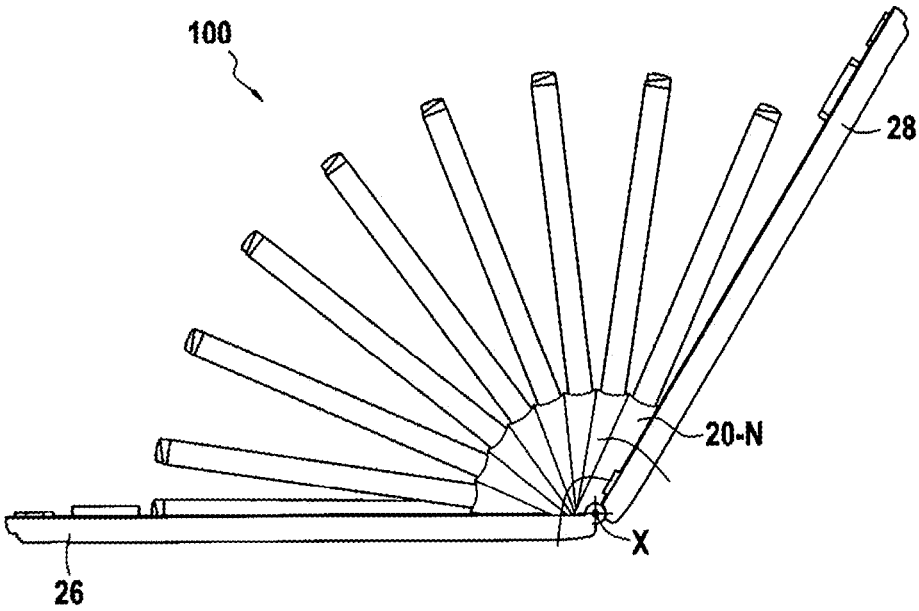
Figure 5E:
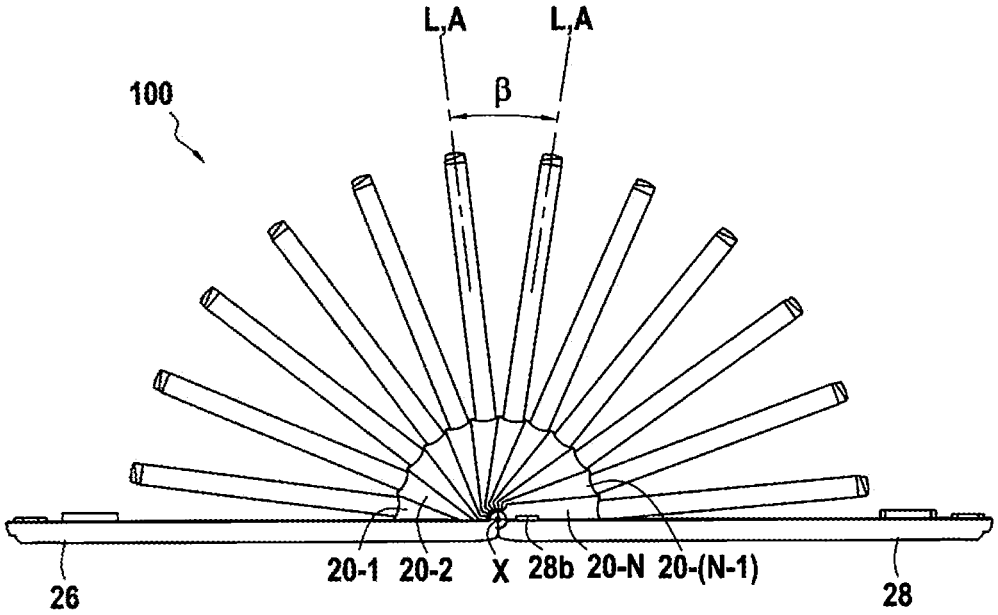

FIGS. 5A and 5E show the device 10 seen looking along arrow V in FIG. 1 (i.e. along the axial direction X) respectively in the storage position and in the presentation position. As can be seen in FIG. 5A, the angle between each of the supports 20 in the storage position is less than 2°, in this example the angle being substantially equal to 0° (only one support being drawn with dashed lines, all the others being masked by that support). The term "angle substantially equal to" is intended to leave a margin of error of ±0.5°. With reference to FIG. 5E, the angle between two adjacent supports 20, with this applying to any of the supports 20, is greater than 5°, and in this example the angle β is substantially equal to 15°. As can be seen in FIGS. 3A and 3B, the support 20 forms a sleeve 20*a*. The axis A of the sleeve 20*a* coincides with the axial direction L of each implement and it intersects the rotation axis X. In this example, the axis A of the sleeve 20*a* of each support 20 forms the geometrical line used as a reference for measuring the angles between the various supports 20.

Figure 2:
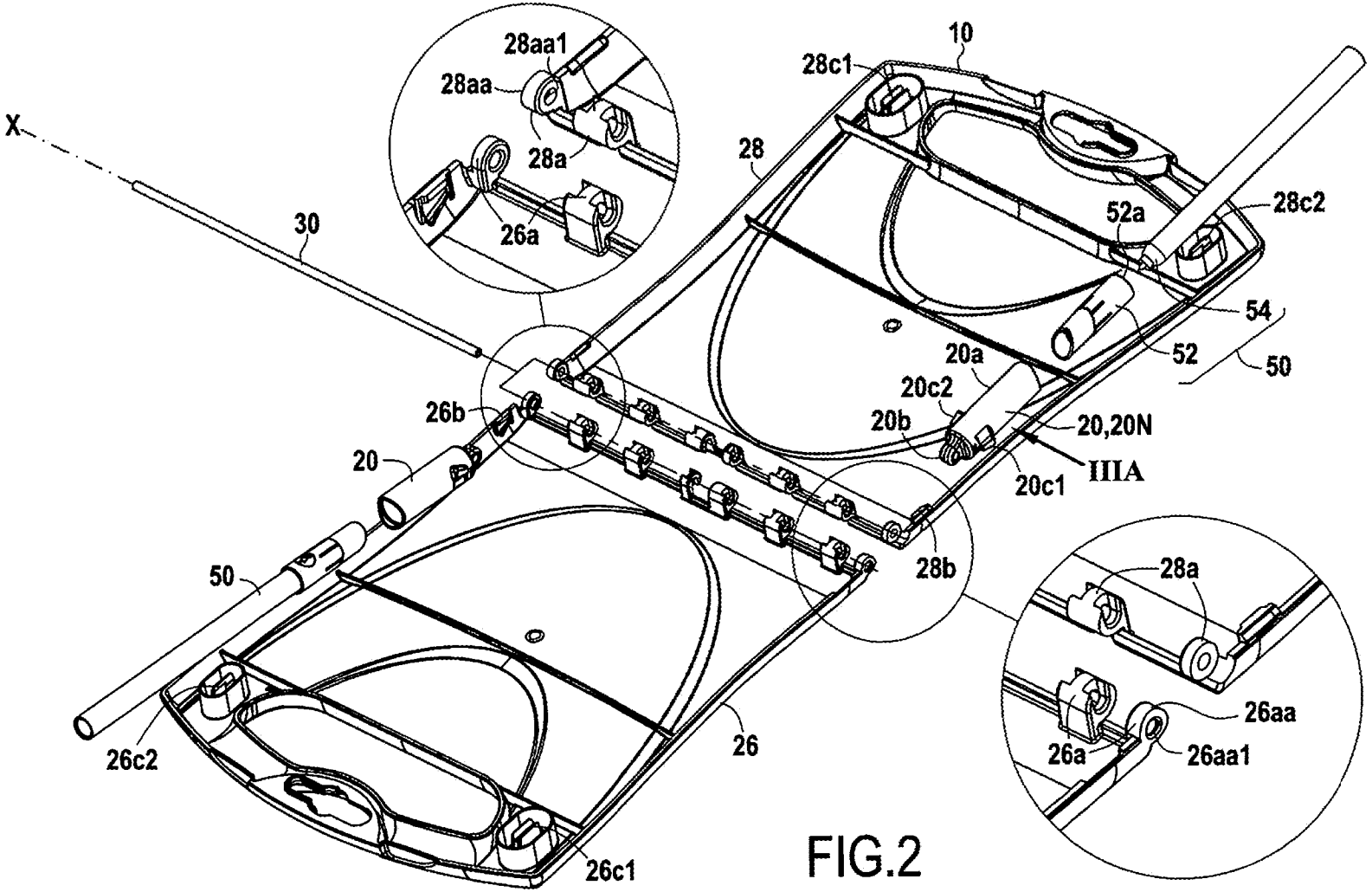
FIG. 2 is a simplified exploded view of the FIG. 1 set.

FIG. 2 shows the structure of the device 10 in greater detail, and it does not show all of the elements of FIG. 1 for reasons of greater clarity. A rod 30 extends along the axial direction X and is common to all of the supports 20 and the covers 26 and 28. Thus, the supports 20 and the covers 26 and 28 are mounted to be rotatable on this common rod 30 about the axis X.

Each cover 26 and 28 presents hinge knuckles 26*a* and 28*a* each receiving the rod 30. It should be observed that the hinge knuckles are shaped specifically to make them easier to fabricate by molding. Each support 20 presents an eyelet 20*b* receiving the rod 30. In this example, each support 20 presents a single eyelet 20*b*, but naturally the supports could present a plurality of eyelets.

Each of the hinge knuckles 26*aa* and 28*aa* belonging respectively to the covers 26 and 28 and arranged at the axial ends of the rod when the device 10 is assembled presents an internal portion in relief, in this example a respective internal annular projection 26*aa*1 or 28*aa*1. The rod 30 co-operates with these projections 26*aa*1 and 28*aa*1 of the hinge knuckles 26*aa* and 28*aa* by snap-fastening so as to prevent the rod 30 from moving in translation along the axial direction X.

Specifically, the rod 30 is a hollow rod that is capable of deforming. Thus, in order to assemble the device 10, the rod 30 is engaged in the hinge knuckle 26*aa* or 28*aa*, with the rod 30 deforming, and the rod 30 is engaged through all of the other hinge knuckles and eyelets 20*b*. When the rod 30 has passed right through the hinge knuckles 26*aa* or 28*aa*, it becomes disengaged from the internal projection of said hinge knuckle, it returns to its initial shape, and it co-operates axially in abutment firstly against the annular projection 26*aa*1 of the hinge knuckle 26*aa* in a first direction along the axis X, and secondly in abutment against the annular projection 28*aa*1 of the hinge knuckle 28*aa* in a second direction along the axis X, opposite to the first direction.

There follows a description of how the supports 20 co-operate with one another. Each support 20 has a pair of lugs 20*c*1 and 20*c*2, these lugs extending along the axial direction X away from each other (i.e. in opposite directions along the axis X). In other words, each support 20 presents a lug extending axially towards an adjacent support 20. Thus, each support 20 presents at least as many lugs as there are adjacent support(s).

FIG. 3A shows a support 20 seen along arrow IIIA of FIG. 2, while FIG. 3B shows the support 20 of FIG. 3A as seen along allow IIIB. As can be seen, the lugs 20*c*1 and 20*c*2 are offset from each other along the azimuth direction Z. The lugs 20*c*1 and 20*c*2 are offset in this example by an angle $\alpha$ equal to 15°. Furthermore, in this example, the lugs 20*c*1 and 20*c*2 are equidistant from the axis A, such that each lug departs from each the axis A by an angle $\alpha/2=7.5°$. By adjusting the angle $\alpha$, the angle $\beta$ between the supports 20 in the presentation position is directly adjusted.

Each lug of each support is configured to co-operate in abutment with the corresponding lug of the adjacent support. Thus, each lug 20*c*1 of a support 20 is configured to co-operate in abutment with the lug 20*c*2 of the adjacent support, and vice versa. Thus, each support has a pair of lugs 20*c*1 and 20*c*2, and each lug 20*c*1 and 20*c*2 in each pair of lugs is configured to co-operate in abutment with the corresponding lug 20*c*2 and 20*c*1, respectively of the adjacent supports 20.

It should be observed that in the storage position, since the angle between all of the supports 20 is substantially zero, the axes A of all of the supports are arranged in parallel. It can thus be considered that in the storage position all of the supports 20 are masked by the support 20 shown in FIG. 3A, such that all of the lugs 20*c*1 are in alignment in the axial direction and all of the lugs 20*c*2 are likewise in alignment in the axial direction (i.e. perpendicularly to the plane of the figure). In general manner, it can be observed that, while in the storage position, the lug 20*c*1 or 20*c*2 of a support is offset in azimuth relative to the corresponding lug 20*c*2 or 20*c*1 respectively of the adjacent support.

Returning to FIG. 1, when considered in the axial direction X, the plurality of supports 20 includes a first support 20 that is referenced 20-1 and a last support 20 that is referenced 20-N. In this example, there are twelve supports, such that N=12, but naturally, in a variant, there could be more or fewer supports. It can also be understood that classifying the supports from first to last is entirely arbitrary, and the first support could equally well be considered as being the last, and vice versa.

In this example, the supports 20-1 and 20-N are identical to all of the other supports 20, i.e. each of them presents a pair of lugs 20*c*1 and 20*c*2. Thus, only the lug 20*c*2 of the support 20-1 co-operates in abutment with a corresponding lug 20*c*1 in of the adjacent support 20-2 (i.e. the second support in the plurality of supports 20), while only the lug 20*c*2 of the support 20-N co-operates with the corresponding lug 20*c*1 of the adjacent support 20-(N−1) (i.e. the penultimate support in the plurality of supports 20), it being understood that each of the first and last supports has only one adjacent support.

In this example, each cover 26 and 28 has a respective projection 26*b* or 28*b* co-operating in abutment respectively with the lug 20*c*2 of the first support 20-1 and with the lug 20*c*1 of the last support 20-N. In other words, the lug 20*c*2 of the first support 20-1 co-operates in abutment with the cover 26, while the lug 20*c*1 of the last support 20-N co-operates in abutment with the cover 28.

Figure 4:
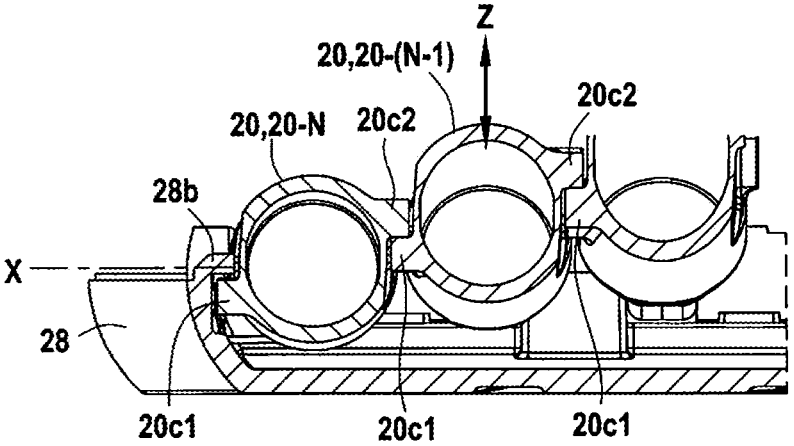
FIG. 4 is a section view on plane IV of FIG. 1.

FIG. 4 is a section view on section plane IV of FIG. 1. This figure shows how the lugs of a support abut against the corresponding lugs of the adjacent supports, and how the lug 20*c*1 of the last support 20-N co-operates with the projection 28*b* of the cover 28. In general manner, it may be observed that the lugs co-operate in abutment in the azimuth direction Z.

Naturally, in a variant, the first support 20-1 and the last support 20-N need not have a lug 20*c*2 or 20*c*1, respectively, so that they do not co-operate with the covers 26 and 28, respectively. Under such circumstances, the first and last supports 20-1 and 20-N are different from the other supports 20, since each of them presents only one lug extending towards the adjacent support, namely the lug 20*c*1 for the first support 20-1 and the lug 20*c*2 for the last support 20-N.

Furthermore, as can be seen in FIG. 3A, each support 20 presents an internal annular rib 20*d* for co-operating with the cap 52 of a writing instrument 50. Naturally, such a cap 52 forms one end of the writing instrument 50. In this example, the rib 20*d* co-operates with the free edge 52*a* of the cap 52 defining the opening of the cap 52 for inserting the body 54 of the writing instrument 50. The cap 52 also co-operates by snap-fastening with the body 54, e.g. by means of projections (not shown) on its inside surface. In well-known manner for the person skilled in the art, the projections and the rib 20*d* are given dimensions such that the force needed for extracting the cap 52 from the support 20 is greater than the force needed for extracting the body 50 from the cap 54. Thus, while using a writing instrument 10, its cap 52 remains with the support 20, thereby considerably reducing the risk of losing the cap 52.

With reference to FIGS. 5A to 5E, there follows a description of the kinetics for passing the device 10 from its storage position to its presentation position.

In FIG. 5A, the device is in the storage position. In this position, the box 32 is in its closed position, and the axes A of all of the supports 20 are arranged in substantially the same plane such that the angle between any two supports 20 is substantially zero. It should be observed that the covers 26 and 28 are fitted with complementary locking means 26*c*1, 26*c*2, and 28*c*1, 28*c*2. In this example, the means 26*c*1 and 28*c*1 are identical and they co-operate respectively with the means 28*c*2 and 26*c*2, which are likewise identical (see FIG. 1). The means 26*c*1 and 28*c*1 comprise a pair of resilient tongues, each having a hook, while the means 26*c*2 and 28*c*2 comprise a single tongue having hooks on each of its opposite faces for co-operating by snap-fastening with the hooks of the means 26*c*1 and 28*c*1. Naturally, any other form of complementary locking means could be envisaged. Thus, when the box 32 is in the closed position, it is locked by these complementary locking means 26*c*1, 26*c*2, 28*c*1, and 28*c*2. These means can be unlocked merely by applying force by hand, by pulling on the handles 26*d* and 28*d* of each of the covers 26 and 28.

In order to bring the device 10 from its storage position to its presentation position, the box 32 is opened. Thus, on unlocking the covers 26 and 28 from the closed position, and thus the set 10 from the closed position, the cover 28 is caused to pivot relative to the cover 26. After going through a predetermined angular stroke, in this example 7.5°, i.e. the angle between the lug 20*c*1 of the last support 20-N and the projection 28*b* of the cover 28 in the storage position, the projection 28*b* of the cover 28 comes into abutment against the lug 20*c*1 of the last support 20-N and drives it in rotation.

Thus, the cover 28 and the support 20-N are coupled in rotation in the direction for opening the cover 28 as from the predetermined angular stroke of the cover 28.

By continuing to rotate the cover 28, the last support 20-N carries the adjacent support 20-(N−1) at the end of a predetermined angular stroke, in this example 15°, i.e. the angle between the corresponding lugs 20*c*1 and 20*c*2. Thus, the adjacent lugs are in abutment and the adjacent supports are coupled to rotate together in the opening direction of the cover 28 as from the predetermined angular stroke between the adjacent supports. FIGS. 5B and 5C thus show intermediate positions in which some of the supports 20 have already been driven and deployed to form a helix while opening the cover 28.

FIG. 5E shows the presentation position of the device 10 in which the box 32 is in its open position, with all of the supports 20 being deployed in a helical shape, and all of the lugs pressing against one another with the lug 20*c*2 of the first support 20-1 pressing against the projection 26*b* of the cover 26 and the lug 20*c*1 of the last support 20-N pressing against the projection 28*b* of the cover 28. This procures particularly reliable stability in the presentation position in this example of the storage and presentation device.

Naturally, it is entirely possible to bring the device 10 from the storage position to the presentation position by opening the cover 26 instead of the cover 28, with this taking place in strictly similar manner, with the supports being deployed beginning with the first support 20-1 instead of the last support 20-N.

Figure 6A:
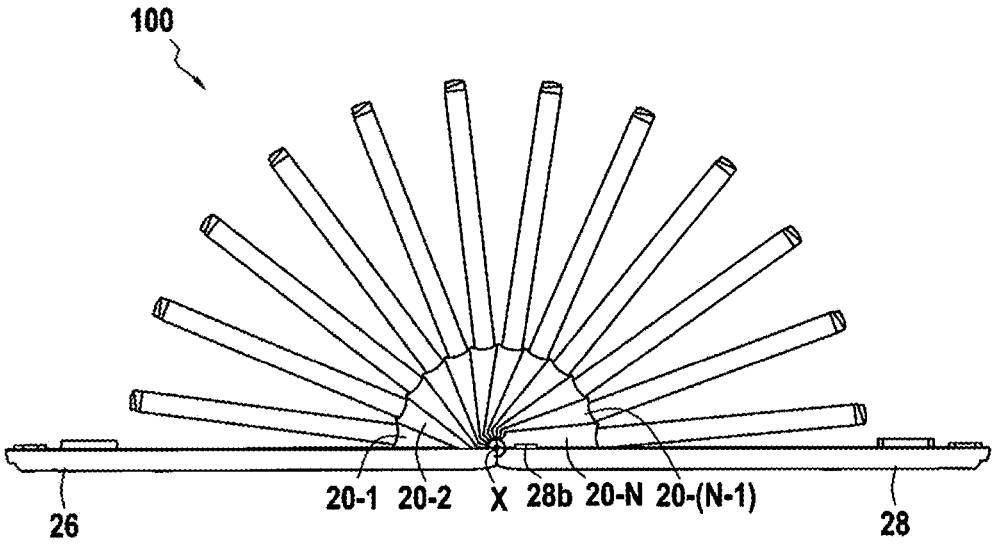
FIGS. 6A to 6D show different steps in the kinetics of closing the box and causing the storage and presentation device as seen looking along arrow V in FIG. 1 to pass from the presentation position to the storage position.

With reference to FIGS. 6A to 6D, there follows a description of the kinetics of passing the device 10 from its presentation position to its storage position. FIG. 6A corresponds to FIG. 5E with the device 10 in its presentation position, while FIG. 6D corresponds to FIG. 5A, with the device 10 in its storage position.

Figure 6B:
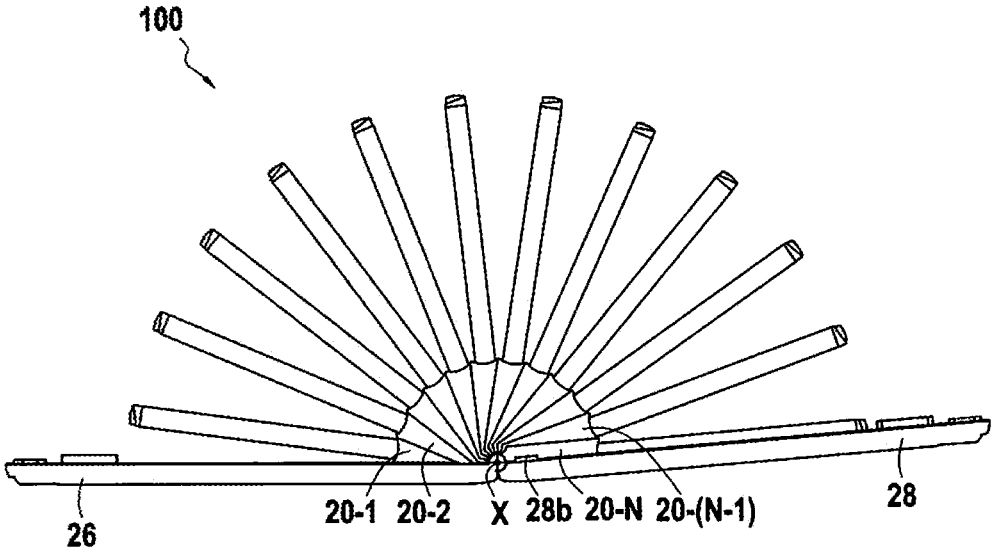
Figure 6C:
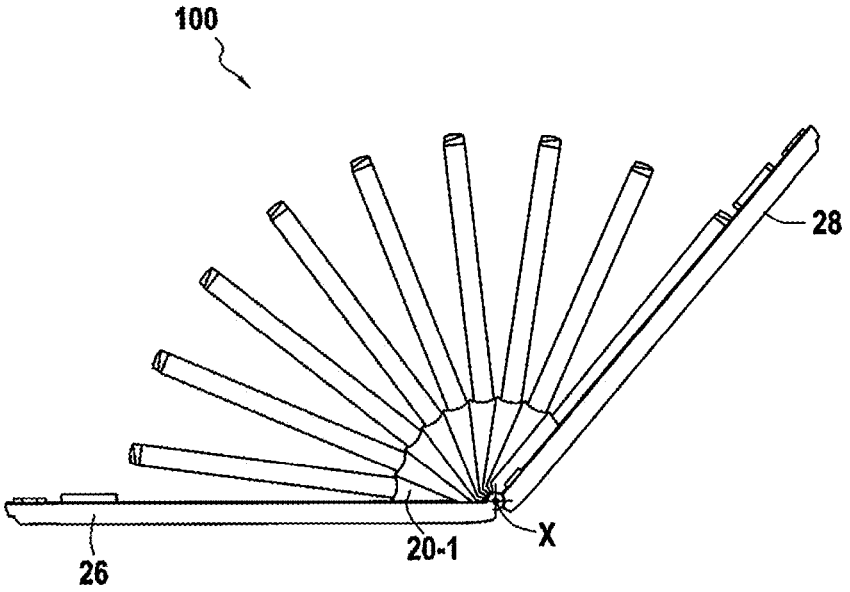

In order to bring the device from the presentation position to the storage position, the box 32 is closed. Thus, one of the covers is moved back towards the other. By moving back the cover 28, the lug 20*c*1 of the last support 20-N and the projection 28*b* are no longer in contact, while the support 20-N and/or the writing instrument 10 carried by the support 20-N come into contact with the cover 28 itself, thereby carrying the support 20-N and the writing instrument 10 towards the storage position, as shown in FIG. 6B. This figure shows an intermediate position in which a certain number of supports and/or writing instruments are bearing against the cover 28 and are being taken by the cover 28 towards the storage position.

Figure 6D:
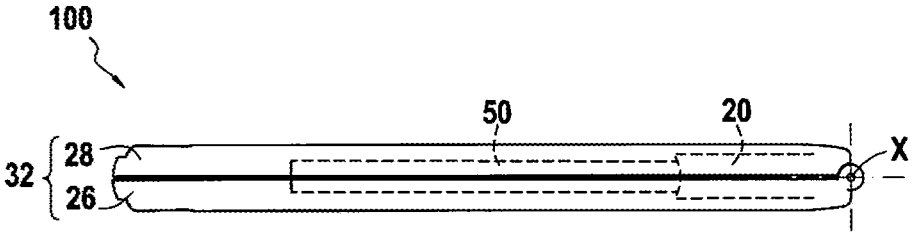

FIG. 6D shows the final storage position, in which the supports and the writing instruments have all been taken by the cover 28, with the box 32 being closed. Naturally, it is entirely possible to bring the device 10 from the presentation position to the storage position by moving back the cover 26 instead of the cover 28, with this taking place in strictly similar manner, the supports being folded down beginning with the first support 20-1 instead of the last support 20-N.

Although the present invention is described with reference to specific embodiments, it is clear that modifications and changes could be undertaken on those embodiments without going beyond the general ambit of the invention as defined by the claims. In particular, individual characteristics of the various embodiments that are shown and/or mentioned may be combined in additional embodiments. Consequently, the description and the drawings should be considered in a sense that is illustrative rather than restrictive.

The invention claimed is:

1. A storage and presentation device comprising:

a first cover, a second cover, and a plurality of supports;

the first cover, the second cover and the plurality of supports all being pivotally mounted on a rod, the rod extending along and defining a common axis;

the plurality of supports extending perpendicularly to the common axis and being configured to support a plurality of writing instruments;

the first and second covers forming a box, and being rotatably mounted relative to each other about the common axis, the box being closed in a storage position, and open in a presentation position, at least one of the first and second covers forming a base while in the presentation position;

the first and second covers including hinge knuckles, the rod being engaged with two of the hinge knuckles by snap-fastening whereby the rod is prevented from moving axially.

2. The storage and presentation device according to claim 1, wherein the plurality of supports includes a first end support and a last end support with a number of other supports therebetween, the first end support including at least a first end lug and the last end support including at least a second end lug, the first end lug extending axially towards an adjacent one of the number of other supports and the second end lug extending axially towards another adjacent one of the number of other supports, the number of other supports including a primary lug and a secondary lug, the primary lug extending axially away from the secondary lug, each lug of the first end lug, the second end lug, the primary lug and the secondary lug of the plurality of supports being in abutment with a corresponding lug of the first end lug, the second end lug, the primary lug and the secondary lug of one of the plurality of supports that is adjacent thereto and being offset in azimuth relative thereto when in the storage position, the azimuth direction being defined by the rotation direction of each support of the plurality of supports so that moving each support of the plurality of supports through a predetermined angular stroke in a first rotation direction couples each support of the plurality of supports with another of the plurality of supports that is adjacent thereto in the first rotation direction by co-operational abutment between corresponding lugs of the first end lug, the second end lug, the primary lug and the secondary lug.

3. The storage and presentation device according to claim 1, wherein the plurality of supports are identical, each of the plurality of supports having a pair of lugs, each lug of each of the pair of lugs extending axially away from the other lug of the pair of lugs, while being offset relative to each other in the azimuth direction.

4. The storage and presentation device according to claim 1, wherein each of the plurality of supports is pivotally mounted on the rod.

5. The storage and presentation device according to claim 1, wherein the plurality of supports includes a first end support and a last end support with a number of other supports therebetween; the first end support and the last end support each include a lug; the lug of the first end support being in abutment with one of the first or second covers, while the lug of the last end support being in abutment with the other of the first or second covers; whereby opening the box carries the plurality of supports in rotation and passes each of the plurality of supports in succession from the storage position to the presentation position.

6. The storage and presentation device according to claim 1, wherein the first and second covers are fitted with complementary locking mechanisms for locking the first and second covers together in the storage position.

7. The storage and presentation device according to claim 1, wherein each of the plurality of supports forms a sleeve configured to receive and hold one end of one of the writing instruments.

8. The storage and presentation device according to claim 1, wherein an axial angle between each of the plurality of supports in the storage position is less than 2°, and the axial angle between the plurality of supports in the presentation position is greater than or equal to 5°.

9. The storage and presentation device according to claim 1, wherein each of the writing instruments includes a cap and a body, each of the plurality of supports being configured to co-operate with the cap of a respective writing instrument in such a manner that a force needed for extracting each one of the caps from the respective support is greater than a force needed for extracting the body of one of the writing instruments from its respective cap.

* * * * *